US005613887A

United States Patent [19]

Kobayashi

[11] Patent Number: 5,613,887

[45] Date of Patent: Mar. 25, 1997

[54] JET PROPULSION UNIT CONDITION INDICATOR

[75] Inventor: Noboru Kobayashi, Iwata, Japan

[73] Assignee: Yamaha Hatsudoki Kabushiki Kaisha, Iwata, Japan

[21] Appl. No.: 414,719

[22] Filed: Mar. 31, 1995

[30] Foreign Application Priority Data

Apr. 1, 1994 [JP] Japan ..... 6-065068

[51] Int. Cl.[6] ..... B63H 11/103

[52] U.S. Cl. ..... 440/47; 440/38

[58] Field of Search ..... 114/270; 440/38, 440/39, 47, 88; 60/221, 222

[56] References Cited

U.S. PATENT DOCUMENTS 4,100,877 7/1978 Scott et al. ..... 440/38

5,244,425 9/1993 Tasaki et al. ..... 440/38

OTHER PUBLICATIONS

M&E Marine Suppy Company, 1988 Catalog, p. 66, Collingswood, N.J. Oct. 17, 1988.

*Primary Examiner*—Stephen Avila

*Attorney, Agent, or Firm*—Knobbe, Martens, Olson & Bear LLP

[57] ABSTRACT

A number of embodiments of jet-propelled watercraft embodying a combined jet propulsion unit and propulsion unit condition sensor. The condition sensor is contained within the outer housing of the jet propulsion unit and may be formed either in the grilled inlet opening, the water inlet portion, the straightening vane portion, or the discharge nozzle portion.

29 Claims, 5 Drawing Sheets

JET PROPULSION UNIT CONDITION INDICATOR

BACKGROUND OF THE INVENTION

This invention relates to a jet-propelled watercraft, and more particularly to a condition indicator for indicating the operating condition of the jet propulsion unit.

The advantages of jet propulsion units for propelling watercraft are well known and acknowledged. Such units permit very efficient propulsion of a watercraft and also, if concealed within a recess in the tunnel, provide a neat appearing watercraft.

There is, however, a particular problem with jet-propelled watercraft, which is shared in part with propeller-driven watercraft. That is, if the speed at which the impeller is driven is too high, then cavitation can occur, and performance deteriorates. With a jet propulsion unit it is difficult for the operator to readily discern that this cavitation condition exists. Thus, the operator is not always in a position to be able to properly control the speed at which the jet propulsion unit is driven so as to obtain optimum performance.

It is, therefore, a principal object of this invention to provide an improved and simplified indicator that will permit an operator to operate a jet propulsion unit at its optimum condition.

It is a further object of this invention to provide an improved indicator that will indicate when a cavitation condition exists in a jet propulsion unit of a watercraft.

It is a further object of this invention to provide a combined jet propulsion unit and condition indicator therefor.

SUMMARY OF THE INVENTION

This invention is adapted to be embodied in a combined water jet propulsion unit and condition indicator assembly. The assembly is comprised of an outer housing that defines a water inlet opening, a water inlet duct through which water from the water inlet opening is drawn, and an impeller housing portion in which an impeller is rotatably journalled. A discharge nozzle portion is formed downstream of the impeller portion and through which the water pumped by the impeller is discharged for providing a propulsion force to a watercraft. A condition sensor is mounted on one of the jet propulsion unit housing portions and in the path of water that flows through the jet propulsion unit.

DETAILED DESCRIPTION OF THE PREFERRED EMBODIMENTS OF THE INVENTION

Figure 1:
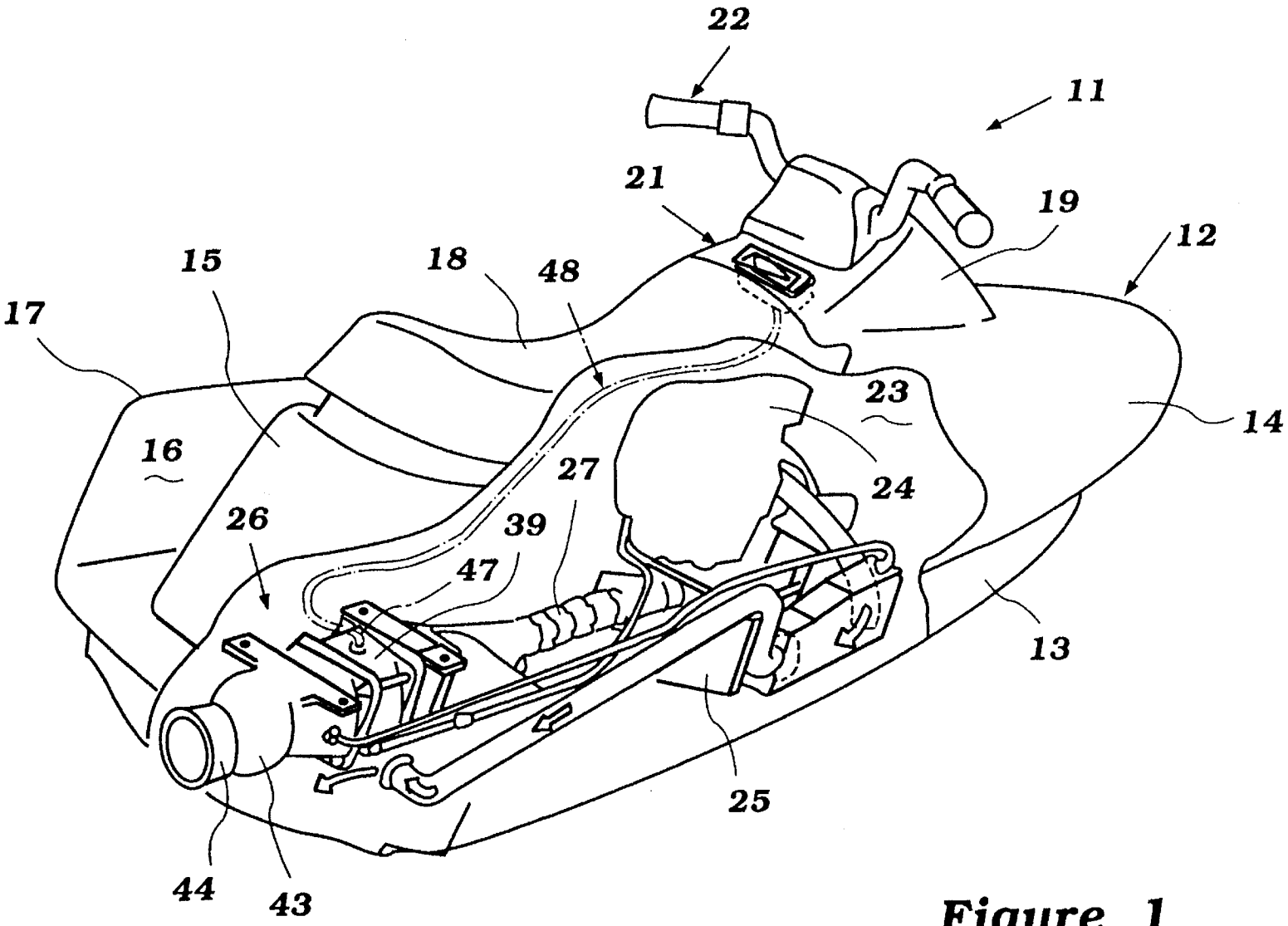
FIG. 1 is a rear side perspective view of a watercraft constructed in accordance with an embodiment of the invention, with a portion of the hull structure broken away to show the propulsion unit.

Referring now in detail to the drawings and initially to FIG. 1, a small personal-type watercraft constructed in accordance with an embodiment of the invention is identified generally by the reference numeral 11. As has been noted, the invention has particular utility with small personal watercraft, but its application is not limited thereto. Therefore, the description of the watercraft 11 will be only general in nature, and except for the jet propulsion unit and the condition-indicating device, the invention may be employed with any type of watercraft. Thus, the full details of the watercraft 11 will not be described, and where any details are omitted, the construction omitted may be assumed to be of any known type.

The watercraft 11 is comprised of a hull assembly, indicated generally by the reference numeral 12, which includes a hull portion 13 and a deck portion 14. These hull portions 13 and 14 may be formed from any suitable material such as a molded fiberglass reinforced resin or the like.

The rear part of the deck portion has a raised pedestal 15 which is bounded on its sides by foot areas 16 defined by raised outer gunnels 17. A seat 18 is mounted on the raised portion 15 and is adapted to receive a rider/operator seated in straddle fashion thereon. If additional passengers are to be carried, they may be carried in a tandem fashion behind the rider/operator.

A raised control area 19 is supported to the front of the seat 18 and has a dash panel on which an instrument, in the form of a condition indicator 21 and specifically a cavitation at pressure indicator, is mounted. A handlebar assembly 22 is positioned forwardly of the instrument 21 for control of the watercraft 12 in a manner which will be described.

The area to the front of the hull 12 between the hull portion 13 and deck portion 14 forms an engine compartment, indicated generally by the reference numeral 23. An internal combustion engine or other form of prime mover, indicated generally by the reference numeral 24, is supported in the engine compartment 23 in a known manner. This engine 24 may be positioned at least in part beneath the front part of the seat 18 and beneath the raised control area 19. The rear end of the engine compartment is defined by a vertically extending bulk head 25.

The rear center underside of the hull portion 13 is provided with a tunnel area or recess in which a jet propulsion unit, indicated generally by the reference numeral 26, is supported. The jet propulsion unit 26 is driven through a drive shaft arrangement, indicated generally by the reference numeral 27, which affords, among other things, a flexible coupling to the output shaft of the engine 24.

Figure 2:
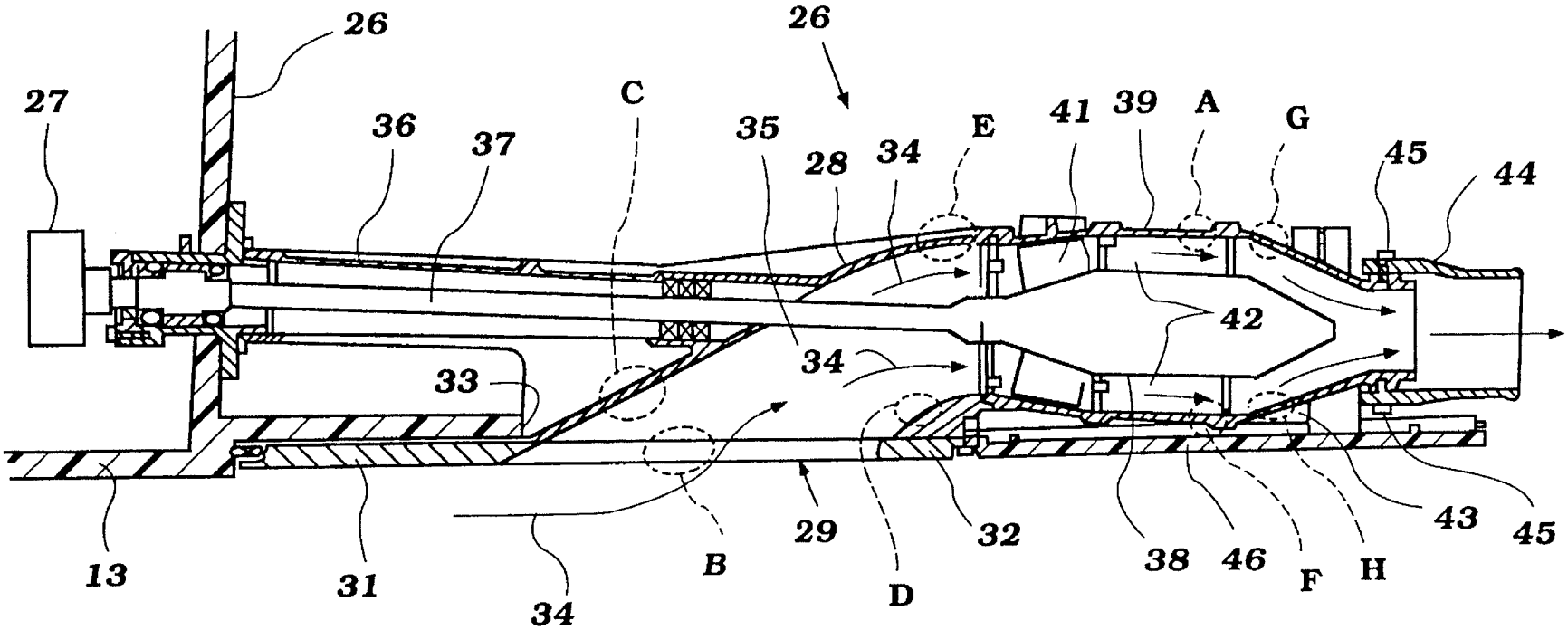
FIG. 2 is an enlarged cross-sectional view taken through the jet propulsion unit of the watercraft and shows a number of embodiments of condition sensor locations possible in accordance with the invention.

The construction of the jet propulsion unit 26 may be best understood by reference to FIG. 2, which constitutes a longitudinal cross-sectional view taken through the center of the aforenoted tunnel and jet propulsion unit. The jet propulsion unit 26 is comprised of an outer housing that includes a water inlet portion 28 which cooperates with a grill plate 29 that is affixed to its underside and which has end portions 31 and 32 that extend forwardly and rearwardly beneath an opening 33 formed in the undersurface of the rear portion of the hull portion 13. This grill plate 29 is formed with slots, as will be described later by reference to FIG. 6, for removing large particles from the water that enters, as shown by the arrow 34. This grill plate 29 serves a water inlet duct 35 formed by the housing portion 28.

A tubular extension 36 of the housing portion 28 rotatably receives an impeller shaft 37 which extends rearwardly and which is journalled in a nacelle 38 formed within an impeller portion 39 of the jet propulsion unit 26. The impeller portion 39 has a water inlet opening which is aligned with the outlet end of the water inlet duct 35. An impeller 41 is fixed to the impeller shaft 37 in a known manner and is rotatably driven by the engine 24, as aforenoted. The impeller 41 draws the water through the watercraft, as seen by the arrows 34, and discharges it rearwardly past a plurality of straightening vanes 42 formed around the nacelle 38.

The water is then discharged rearwardly through a discharge nozzle portion 43, which faces in a rearward direction. A steering nozzle 44 is rotatably journalled for steering movement about a vertically extending steering axis on the discharge nozzle portion 43 by a pair of vertically disposed pivot pins 45. The steering nozzle 44 is coupled by means of a bowden wire actuator or the like to the handlebar assembly 22 for steering of the steering nozzle 44 and for effecting steering of the watercraft 12 in a manner well known in this art.

In addition to the steering control by the handlebars 22, other watercraft controls such as a throttle control for the engine 24 may be carried by the handlebar assembly 22.

The underside of the rear portion of the tunnel in which the jet propulsion unit 26 is mounted is closed by means of a closure plate 46 to which the grill plate 29 may be affixed. As a result, a smooth undersurface is provided along the entire under portion of the hull, except around the grilled plate 29.

The foregoing construction may be considered to be conventional, and for that reason, further details of the structure of the watercraft and jet propulsion unit 26, except for the means for providing the condition signal, is not believed to be necessary to permit those skilled in the art to understand and practice the invention.

A pressure sensing port, indicated by the reference numeral 47 and shown in FIG. 1, is disposed, in this embodiment, in an area in the impeller housing 39. This pressure sensing port functions like a venturi tube and conveys a vacuum signal through a conduit 48 to the gauge 21. Either within the gauge 21 or at some other location, a pressure transducer is provided which outputs an electrical signal indicative of pressure which is then converted by an appropriate conversion circuit in the gauge 21 and driver circuit so as to provide either a digital or analog signal indicative of the vacuum in the jet propulsion unit 26 which indicates that water is flowing smoothly and not cavitating.

The configuration of the pressure sensor 47 will be described later, but it will be understood by those skilled in the art that the pressure sensing port 47 may be disposed at any of a plurality of locations in addition to that described. The described location is indicated by the reference character A in FIG. 2 and is provided in the area where the straightening vanes 42 are located. Such alternate locations are, for example, at B in the grill plate 29, at C or D in either the leading or trailing edges of the water inlet path 35 adjacent the grill plate 29, or adjacent the upper end of the outlet of the water inlet portion 35 as indicated at E. In addition, the sensing port may be disposed at the lower side of the straightening vane portion of the impeller housing 39, as indicated at F, or at the top or bottom of the discharge nozzle 43, as indicated at G and H.

Figure 3:
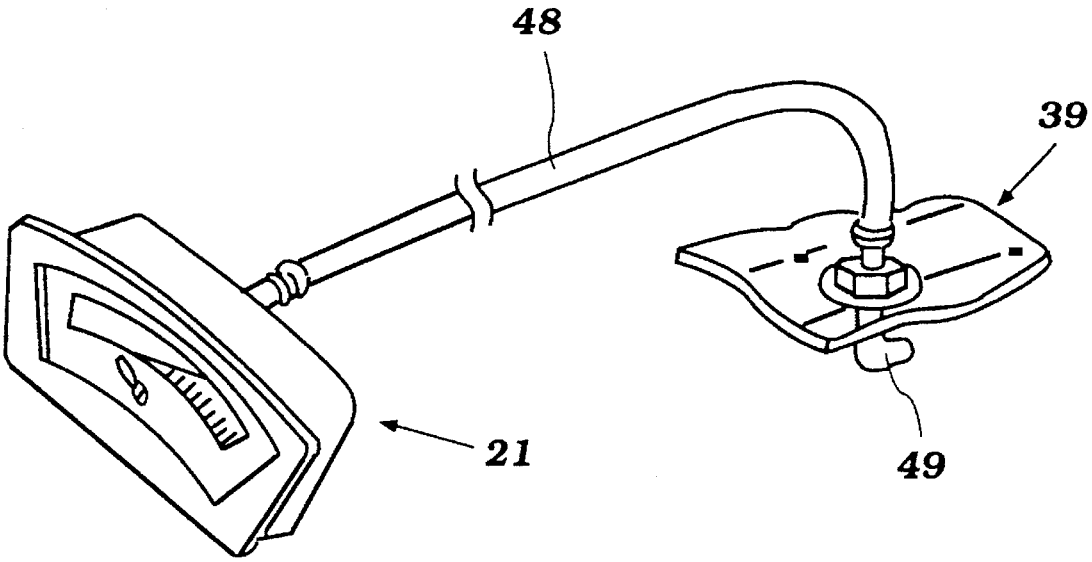
FIG. 3 is a partial perspective view showing the components of the condition-indicating system of this embodiment

As may be seen in FIG. 3, the particular connection may include a right-angle bend 49 which can face either perpendicular to or at opposite to the water flow path through the jet propulsion unit 26. In either case the vacuum signal will be related to water flow speed.

Figure 4:
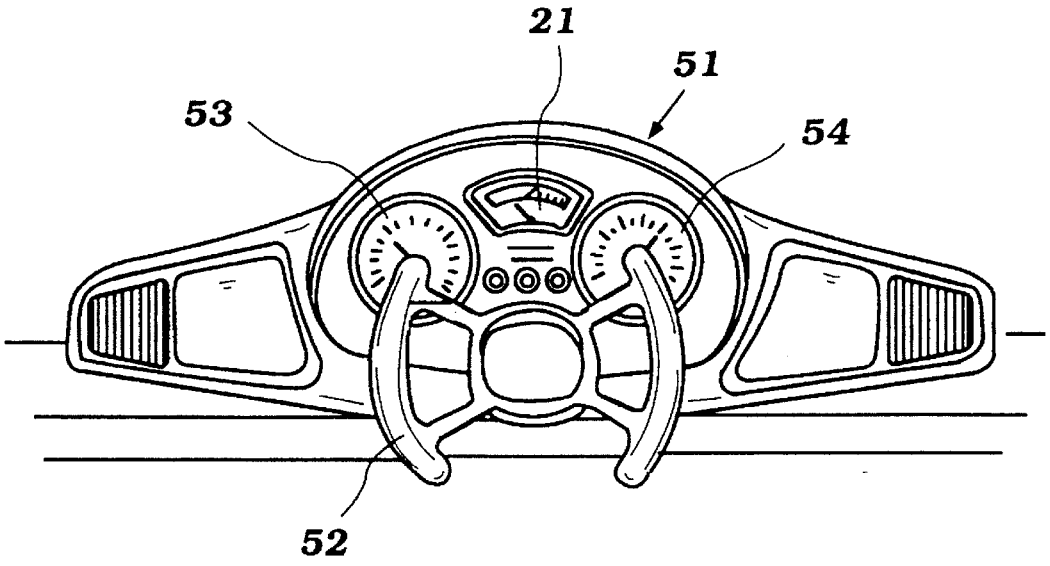
FIG. 4 is a rear elevational view showing a control panel of a watercraft constructed in accordance with another embodiment of the invention.

FIG. 4 is a view showing how the speed indicator gauge 21 may be utilized in conjunction with another type of watercraft control; for example, the type of watercraft having a bench seat or individual side-by-side seats with a dash panel, indicated generally by the reference numeral 51, being disposed to the front of the rider/operator seat. A steering wheel 52 is journalled at the lower end of the dash panel 51, and the speedometer gauge 21 is disposed at the top of the panel 51. It is flanked on opposite sides by other gauges such as a tachometer 53 and water speed indicator 54. In addition, warning lights and other instruments may be mounted on the dash panel 51.

Figure 5:
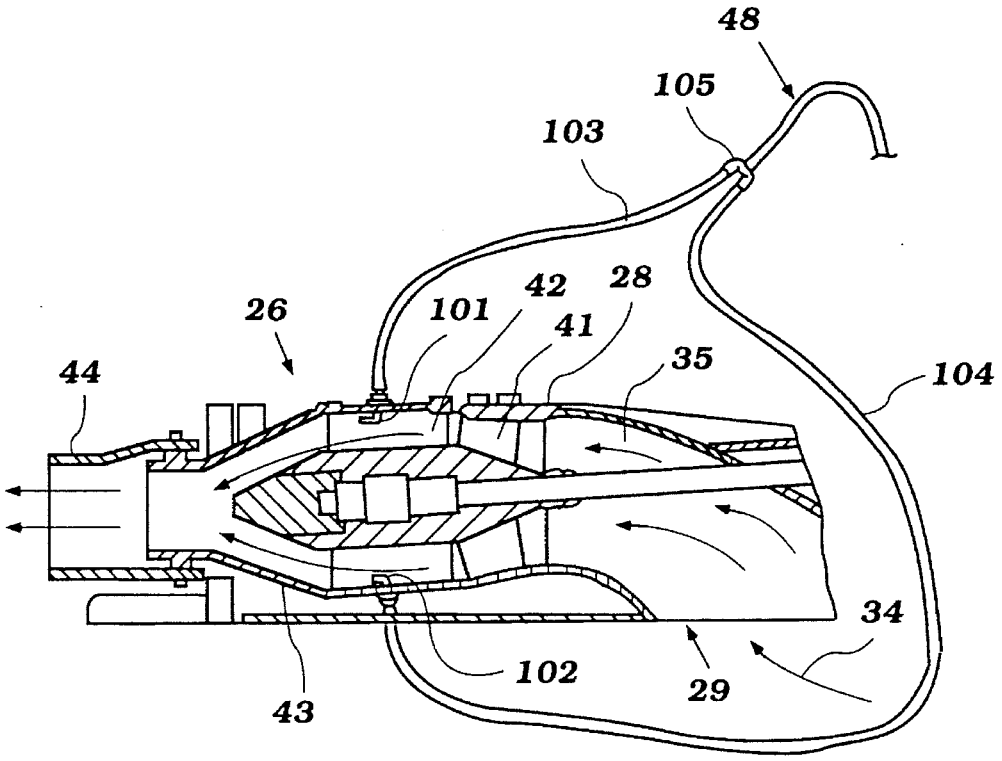
FIG. 5 is a cross-sectional view, in part similar to FIG. 2, and shows a yet further embodiment of the invention.

In the embodiments of the invention as thus far described, there has been provided only one pressure pick-up point within the jet propulsion unit 26. In some locations for the pressure pick-up point, particularly where the pickup point is disposed within the impeller housing 39, there may be water velocity differences existent, even at the same axial location. Therefore, in order to provide accurate indication, it may be desirable to sense pressure at two different points and take the average of those pressure signals, and FIG. 5 shows such an embodiment. Except for the location of the pick-up devices and their connections, the construction of the jet propulsion unit 26 is as already described, and therefore, components of this embodiment which are the same as the previously described embodiment have been identified by the same reference numerals and will be described again only insofar as is necessary to understand the construction and operation of this embodiment.

In this embodiment there is provided a first pressure pick-up nozzle 101 in the upper area between a pair of the straightening vanes 42 and a second lower pick-up tube 102 between a pair of lower of the straightening vanes 42. Respective conduits 103 and 104 extend from these pick-up points 101 and 102 to a junction 105 that serves the conduit 48, which transmits the resulting average pressure signal to the gauge 21.

Figure 6:
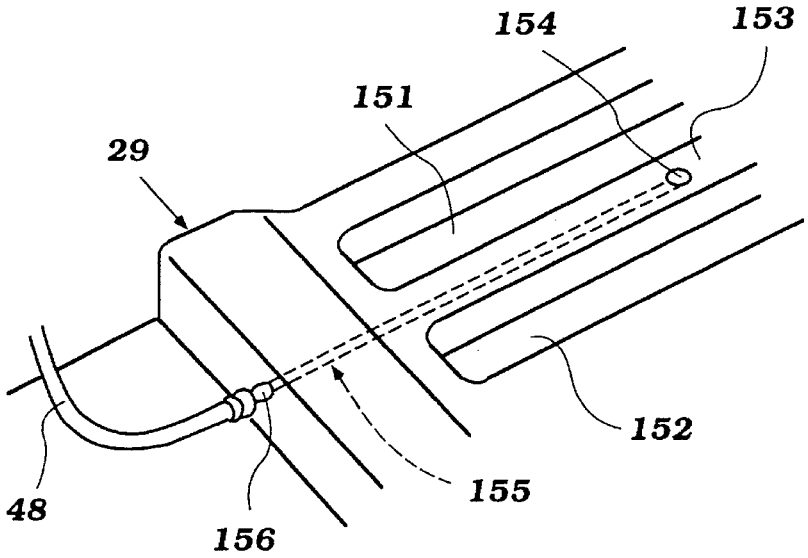
FIG. 6 is a bottom perspective view of an arrangement wherein the condition sensor is mounted in the water inlet grill.

FIG. 6 shows another embodiment wherein the pressure pick-up is provided directly in the grill plate 29, and specifically between a pair of openings 151 and 152 through the bar 153 which separates these openings 151 and 152. The pressure pick-up point is indicated at 154 and communicates with a drilled passage 155 extending through the grill plate 29 to the end adjacent the bulk-head 26.

Figure 7:
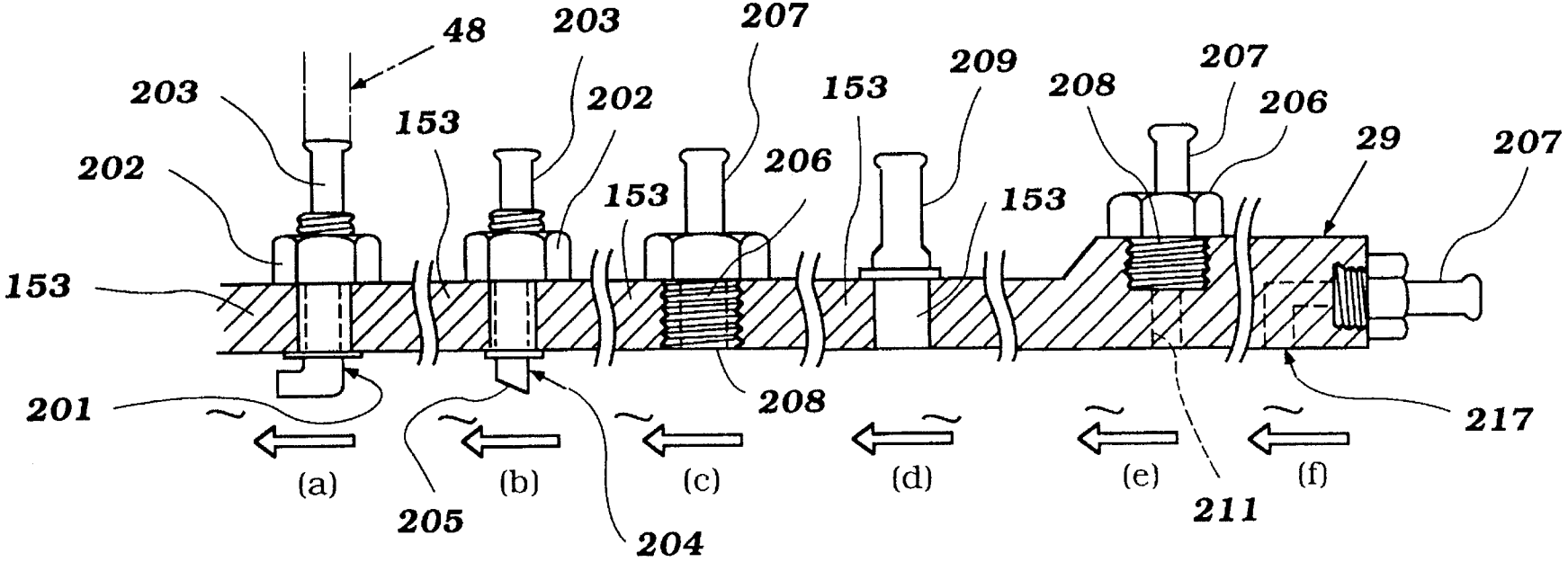
FIG. 7 is an enlarged cross-sectional view showing a number of different ways in which the condition sensor may be mounted in the grill of the jet propulsion unit.

A nipple 156 extends therebeyond and is connected to the conduit 48. The configuration of the pickups and the type of conduitry that may be utilized with them is illustrated in FIG. 7, with various alternatives being shown at a, b, c, d, e, and f. The direction of water flow is indicated by the open arrows in this figure. In the a embodiment, the tube is angularly shaped, as shown at 201, and faces rearwardly. Because of this rearward disposition, foreign objects are not likely to become lodged in the open end of the tube 201, but it will still appropriately sense vacuum. A headed portion 202 permits attachment to the underside of the grill plate 29, and specifically the rib 153 thereof. Hence, a nipple 203 can be formed thereon and connected to the conduit 48.

View b shows another arrangement wherein a tubular extension 204 has a scarfed end 205 that defines an opening facing away from the flow direction and which is connected to the rib 153 in the same manner as embodiment a.

With embodiment c, the pressure pickup constitutes nothing more than a fitting having a headed portion 206 and a nipple portion 207 to which the conduit 48 may be affixed. A threaded part 208 extends into a tapped opening in the rib 153 and has an open end.

Embodiment d shows an arrangement wherein merely a nipple 209 is affixed to the underside of the rib 153.

Embodiments e and f show connections where the pressure pickup is at the end of the grill plate 29 where it has a thicker dimension and is spaced forwardly of the grill openings 151 and 152. The first embodiment uses a fitting like the embodiment of embodiment c, but in this case there is a smaller size opening 211 in the plate at the base of the threaded portion 208.

Embodiment f shows a fitting like the fitting of embodiments c and e, but in this event it faces forwardly so as to provide a more compact assembly, and it cooperates with an angle-shaped drilling 217 formed in the end of the grill plate 29.

From the foregoing description it should be readily apparent that the described embodiments provide a very effective pressure sensor for a watercraft cavitation-indicating system. The sensor can be built into the jet propulsion unit itself and will be protected upon beaching, and also will be protected from impact with foreign objects. In addition, a more accurate reading can be obtained through the use of the pressure sensor. When the operator sees a sudden drop in vacuum he will realize cavitation has occurred and can slow the engine 24 to resume stable operation.

Of course, it is to be understood that the foregoing description is that of preferred embodiments of the invention, and various changes and modifications may be made without departing from the spirit and scope of the invention as defined by the appended claims.

I claim:

1. A combined water jet propulsion unit and condition sensor and indicator, said water jet propulsion unit being comprised of a water inlet housing portion defining a water inlet opening and a water flow path, an impeller housing rotatably journalling an impeller for pumping water through said water inlet housing portion, and a discharge nozzle portion through which water pumped by said impeller is discharged for providing a propulsive force to an associated watercraft, a propulsion unit cavitation sensor mounted in one of said housing portions for providing a signal indicating that said propulsion unit is operating in a condition of cavitation and a condition indicator for receiving a condition signal from said condition sensor and displaying said condition to an operator of a watercraft powered by said water jet propulsion unit.

2. A combined water jet propulsion unit and condition sensor as defined in claim 1, wherein the propulsion unit condition sensor comprises a pressure sensor for providing a pressure signal indicative of water flow.

3. A combined water jet propulsion unit and condition sensor as defined in claim 2, wherein the pressure sensor comprises a tube for generating a venturi vacuum signal.

4. A combined water jet propulsion unit and condition sensor as defined in claim 1, wherein the propulsion unit condition sensor is disposed in the water inlet housing portion.

5. A combined water jet propulsion unit and condition sensor as defined in claim 4, further including a grilled opening across the water inlet opening and wherein the propulsion unit condition sensor is carried by the grilled opening.

6. A combined water jet propulsion unit and condition sensor as defined in claim 5, wherein the propulsion unit condition sensor is disposed within one of the slats separating the grilled openings.

7. A combined water jet propulsion unit and condition sensor as defined in claim 6, wherein the output from the signal propulsion unit condition sensor is transmitted through the underside of the grilled opening.

8. A combined water jet propulsion unit and condition sensor as defined in claim 7, wherein the condition signal is transmitted out of one of the ends of the grilled openings.

9. A combined water jet propulsion unit and condition sensor as defined in claim 7, wherein the propulsion unit condition sensor comprises a pressure sensor for providing a pressure signal indicative of water flow.

10. A combined water jet propulsion unit and condition sensor as defined in claim 9, wherein the pressure sensor comprises a tube for generating a venturi vacuum signal forge.

11. A combined water jet propulsion unit and condition sensor as defined in claim 4, wherein the propulsion unit condition sensor is disposed in the water inlet duct.

12. A combined water jet propulsion unit and condition sensor as defined in claim 11, wherein the propulsion unit condition sensor comprises a pressure sensor for providing a pressure signal indicative of water flow.

13. A combined water jet propulsion unit and condition sensor as defined in claim 12, wherein the pressure sensor comprises a tube for generating a vacuum signal.

14. A combined water jet propulsion unit and condition sensor as defined in claim 1, wherein the propulsion unit condition sensor is formed in the jet propulsion unit housing to the rear of the impeller.

15. A combined water jet propulsion unit and condition sensor as defined in claim 14, wherein the propulsion unit condition sensor is provided in the area immediately behind the impeller.

16. A combined water jet propulsion unit and condition sensor as defined in claim 15, wherein there are provided a plurality of straightening vanes in the impeller housing portion to the rear of the impeller and wherein the condition sensor is disposed in the straightening vane area.

17. A combined water jet propulsion unit and condition sensor as defined in claim 16, wherein the propulsion unit condition sensor comprises a pressure sensor for providing a pressure signal indicative of water flow.

18. A combined water jet propulsion unit and condition sensor as defined in claim 17, wherein the condition sensor comprises a tube for generating a vacuum signal.

19. A combined water jet propulsion unit and condition sensor as defined in claim 14, wherein the propulsion unit condition sensor is disposed in the discharge nozzle housing portion.

20. A combined water jet propulsion unit and condition sensor as defined in claim 19, wherein the propulsion unit condition sensor comprises a pressure sensor for providing a pressure signal indicative of water flow.

21. A combined water jet propulsion unit and condition sensor as defined in claim 20, wherein the pressure sensor comprises a tube for generating a vacuum signal.

22. A combined water jet propulsion unit and condition sensor and indicated as set forth in claim 1, in combination with a watercraft having a hull propelled by said water jet propulsion unit, an engine carried by said hull for driving said water jet propulsion unit, a rider's area in said hull, said condition indicator being mounted in said hull in said rider's area.

23. A combined watercraft as set forth in claim 22, wherein the rider's area defines a control for operation by a rider and wherein the condition indicator is juxtaposed to said control.

24. A combined watercraft as set forth in claim 23, wherein the rider's area is provided with a straddle-type seat on which a rider/operator may be seated therein, the condition indicator and control is disposed forwardly of said seat.

25. A combined water jet propulsion unit and condition sensor comprised of a water inlet housing portion defining a grilled water inlet opening and a water flow path, an impeller housing rotatably journalling an impeller for pumping water through said water inlet housing portion, and a discharge nozzle portion through which water pumped by said impeller is discharged for providing a propulsive force to an associated watercraft, and a propulsion unit condition sensor mounted within one of the slats separating the grilled openings.

26. A combined water jet propulsion unit and condition sensor as defined in claim 25, wherein the output from the propulsion unit condition sensor is transmitted through the underside of the grilled opening.

27. A combined water jet propulsion unit and condition sensor as defined in claim 26, wherein the condition signal is transmitted out of one of the ends of the grilled openings.

28. A combined water jet propulsion unit and condition sensor as defined in claim 26, wherein the propulsion unit condition sensor comprises a pressure sensor for providing a pressure signal indicative of water flow.

29. A combined water jet propulsion unit and condition sensor as defined in claim 28, wherein the pressure sensor comprises a tube for generating a venturi vacuum signal.

* * * * *